US006856289B2

(12) United States Patent
Ma

(10) Patent No.: US 6,856,289 B2
(45) Date of Patent: Feb. 15, 2005

(54) PCB ANTENNA CAPABLE OF RECEIVING FOUR OPERATING BANDS

(75) Inventor: Chun-Chen Ma, Sindian (TW)

(73) Assignee: Tatung Co., Ltd., Taipei (TW)

( * ) Notice: Subject to any disclaimer, the term of this patent is extended or adjusted under 35 U.S.C. 154(b) by 0 days.

(21) Appl. No.: 10/654,998

(22) Filed: Sep. 5, 2003

(65) Prior Publication Data

US 2004/0056806 A1 Mar. 25, 2004

(30) Foreign Application Priority Data

Sep. 20, 2002 (TW) ..... 91214923 U

(51) Int. Cl.[7] ..... H01Q 1/38; H01Q 9/28
(52) U.S. Cl. ..... 343/700 MS; 343/795
(58) Field of Search ..... 343/700 MS, 702, 343/795, 841, 846, 848

(56) References Cited

U.S. PATENT DOCUMENTS 5,537,123 A * 7/1996 Mandai et al. ..... 343/700 MS
5,949,376 A * 9/1999 McDonald et al. .. 343/700 MS
6,507,316 B2 * 1/2003 Mendelsohn et al. 343/700 MS
6,636,180 B2 * 10/2003 Lin et al. ..... 343/700 MS

* cited by examiner

*Primary Examiner*—Thuy Vinh Tran
*Assistant Examiner*—Minh Dieu A
(74) *Attorney, Agent, or Firm*—Bacon & Thomas PLLC

(57) ABSTRACT

An antenna of a four-band printed circuit board is disclosed, which uses metal electrode plates on A, B sides and a substrate interlayer formed of glass fiber dielectric insulator. The A-side electrode plate is grounded to a reflective plane to form a U-like pattern, wherein a left metal sheet is symmetric to a right metal sheet and the two sheets respectively have three gaps so as to form an intermittent metal plane. The middle of the U-like pattern is implemented with four metal ring electrodes and one electrode is circuit-shorted to the B-side electrode plate for increasing antenna sensibility and reducing antenna size. In addition, in this case, one antenna can be shared by four operating bands to receive and transmit via switching, so the manufacturing cost is low and the prior art disadvantage of only receiving and transmitting single- or double-band signal in a typical linear antenna is overcome.

11 Claims, 13 Drawing Sheets

PCB ANTENNA CAPABLE OF RECEIVING FOUR OPERATING BANDS

BACKGROUND OF THE INVENTION

1. Field of the Invention

The present invention relates to a printed circuit board (PCB) antenna and, more particularly, to a PCB antenna capable of receiving four operating bands.

2. Description of Related Art

Recently, wireless communication products have gradually become a part of regular living. For example, mobile communication devices such as cell phones, have advanced to the "Third Generation" (3G) while 'bluetooth' products, providing great flexibility of PC devices etc, are becoming commonplace. The design of modem wireless communication products places great emphasis compactness, versatility, portability and aesthetics. However, when integrating a wireless communication product with a contemporary antenna, the size and appearance of the antenna seriously detract from the aesthetics of the communication product. Furthermore, the antenna can receive only a single band signal, which is not satisfactory. Currently, commercial wireless applications are approaching maturity, especially in reference to the computer information industry such that change from a wired network to a wireless network is well under way. However, in response to 2.4 GHz~2.5 GHz/5.15 GHz~5.25 GHz/5.25 GHz~5.35 GHz/5.725 GHz~5.85 GHz frequency bands being opened by the global wireless local network market, it has become necessary to integrate a number of different band antennas into a single wireless communication product. This integration will occupy too much space in the communication products and reduce convenience and reliability in use.

Therefore, it is desirable to provide an improved antenna to mitigate and/or obviate the aforementioned problems.

SUMMARY OF THE INVENTION

An object of the present invention is to provide a PCB antenna capable of receiving four operating bands, which has the advantages of low manufacturing cost, easy mass-production, high yield, small size and light in mass.

Another object of the present invention is to provide a PCB antenna capable of receiving four operating bands, which is easy to be integrated into a wireless product.

A further object of the present invention is to provide a PCB antenna capable of receiving four operating bands, which provides an antenna easy to be hidden and compatible with the appearance of a wireless product to be integrated.

To achieve the objects, the inventive PCB antenna capable of receiving four operating bands essentially includes: a substrate formed of glass fiber (FR4) dielectric insulator, an A-side metal electrode plate located on one side of the substrate and a B-side metal electrode plate located on the other side of the substrate. The A-side metal electrode plate is grounded to a reflective plane to form a U-like pattern, wherein a left metal sheet is symmetric to a right metal sheet and the two sheets respectively have three gaps so as to form intermittent metal plane. The middle of the U-like pattern is additionally implemented with four metal ring electrodes. The B-side metal electrode plate is circuit-shorted to one of the four metal ring electrodes of the A-side metal electrode plate, wherein line intermittence of the A-side metal electrode plate is totally six fragments, each having 0.2 mm~0.5 mm. Each of the four metal ring electrodes in the middle of the U-like pattern has a ratio of internal to external diameters about 0.25. The internal diameter of circle line of one metal ring electrode the closest to the U-like opening has to be drilled such that the one metal ring electrode and the B-side metal electrode plate are circuit-shorted.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
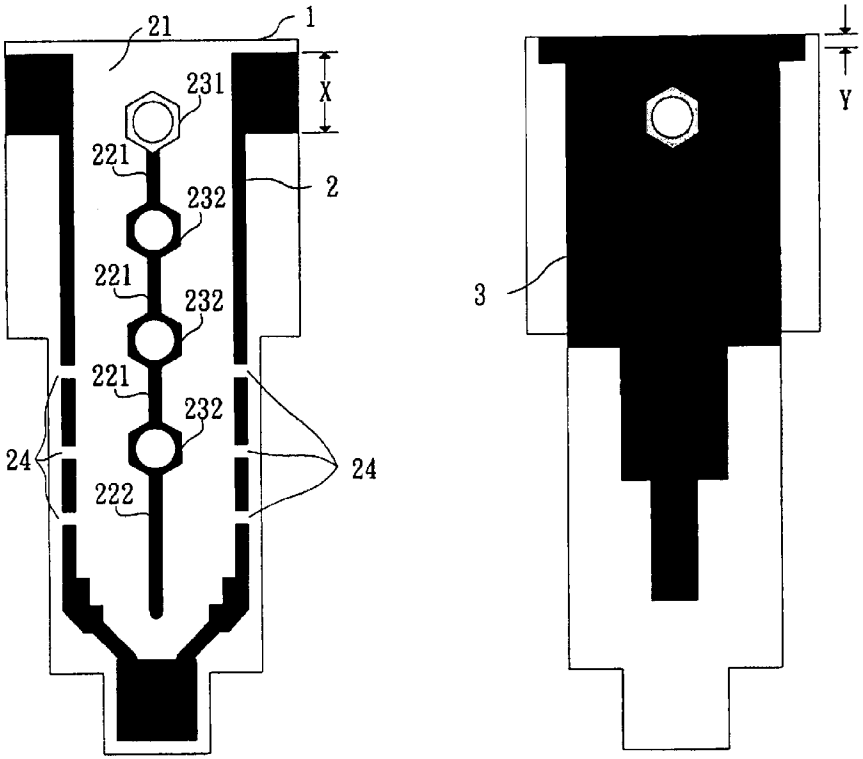
FIG. 1 is a schematic diagram of A-side and B-side electrode plates according to the present invention.

With reference to FIG. 1, there is shown a schematic diagram essentially including a substrate 1, an A-side metal electrode plate 2 and a B-side metal electrode plate 3. The A-side metal electrode plate 2 is located on one side of the substrate 1 and grounded to a reflective plane to form a U opening 21. The U opening 21 has two metal sheets symmetrically located on left and right sides, respectively. Each metal sheet has three gaps 22 so as to form an intermittent metal plane. The middle of the U opening 21 is implemented with four metal ring electrodes 231, 232 and four metal connecting sheets 221, 222. The B-side metal electrode plate 3 is located on the other side of the substrate 1 and circuit-shorted with one metal ring electrode 231 of the A-side metal electrode plate 2.

The A-side and B-side metal electrode plates are implemented on the substrate 1 using printed circuit board (PCB)

processing. In this embodiment, the substrate 1 is preferably formed of a glass fiber (FR4) dielectric insulator. Actual material and thickness for the substrate 1 depend on user requirements.

Each of the four metal ring electrodes in the middle of the U opening 21 has a ratio of internal-to-external diameter about 0.25. The internal diameter of circle line of one metal ring electrode the closest to the U opening has to be drilled such that the one metal ring electrode and the B-side metal electrode plate are circuit-shorted, thereby producing better sensitivity. The four metal connecting sheets 221, 222 connect between the metal ring electrodes and one 222 of them is extended toward the bottom of the U opening.

In this embodiment, the two metal sheets have 6 fragments in total. Each fragment has about 0.2 mm~0.5 mm, such that both A-side and B-side metal electrode plates are intermittent planes. A position X on the top of the U opening of the A-side metal electrode plate 2 has a width of about 3~2.2 multiple proportion to a position Y on the top of the B-side metal electrode plate 3.

Figure 2:
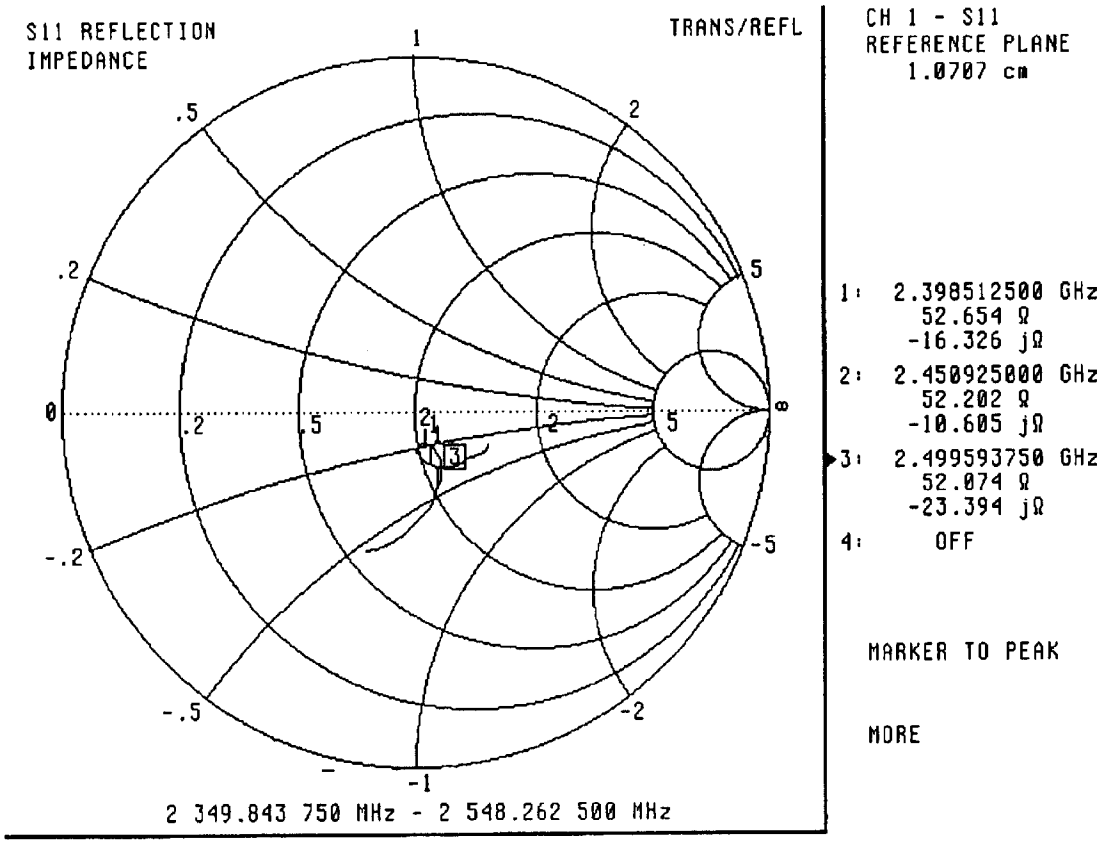
FIG. 2 is a view of a Smith impedance chart measured by a network analyzer at an operating band between 2.4 GHz and 2.5 GHz.
Figure 3:
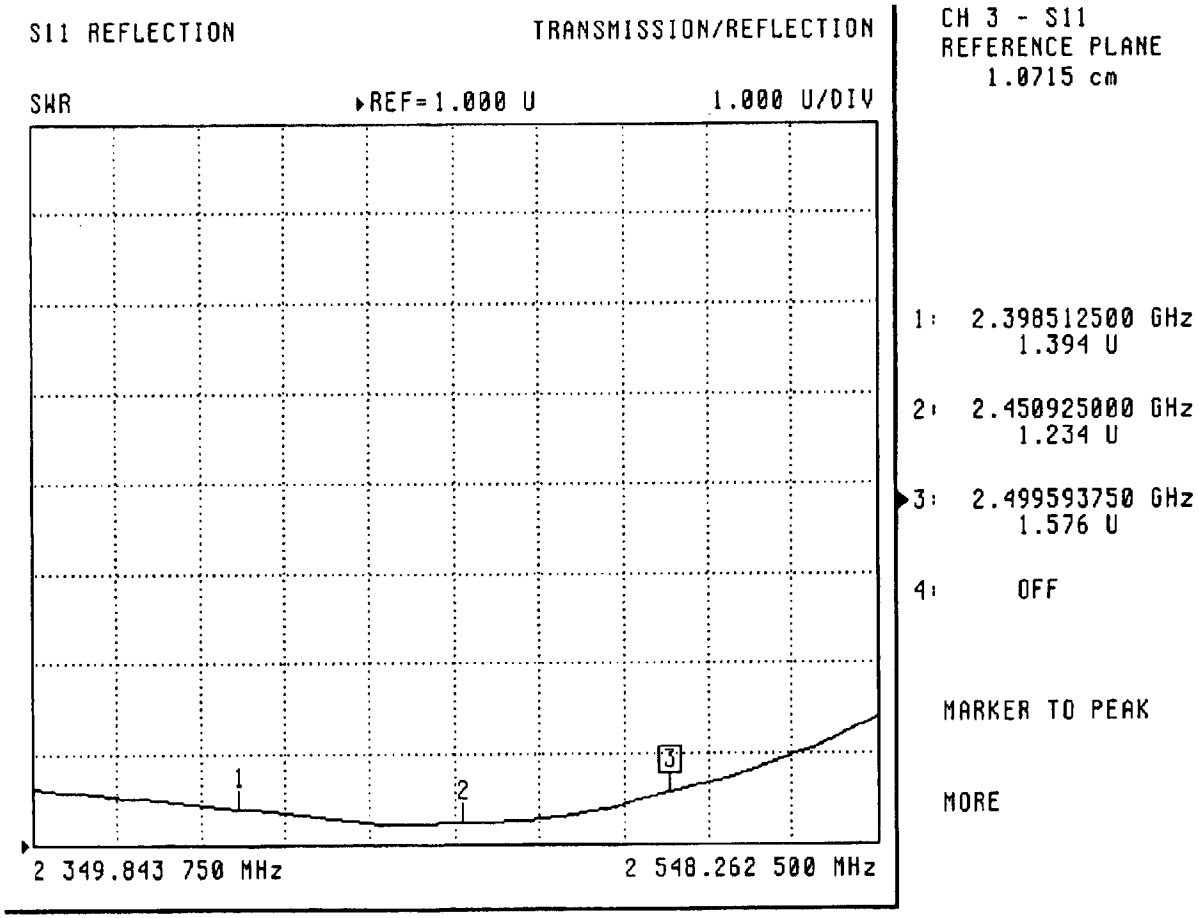
FIG. 3 is a view of a voltage standing wave ratio (VSWR) chart measured by the network analyzer at the operating band between 2.4 GHz and 2.5 GHz.
Figure 4:
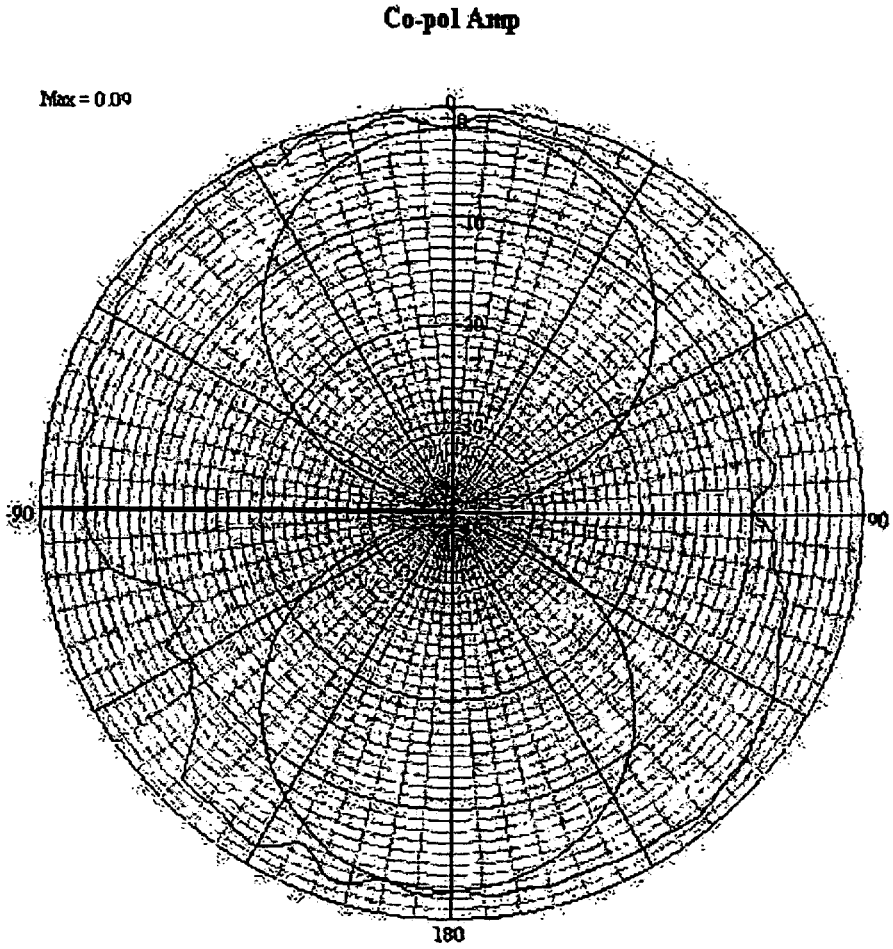
FIG. 4 is a view of antenna radiation pattern at the operating band between 2.4 GHz and 2.5 GHz.

FIGS. 2–4 show corresponding data for an inventive PCB antenna measured at a first operating band (2.4 GHz to 2.5 GHz). FIG. 2 shows a Smith impedance chart for the inventive PCB antenna measured by a network analyzer. As shown in FIG. 2, three important data are shown. When there is a frequency of 2.3985125 GHz, its real input impedance is 52.654 ohms and its imaginary input impedance is −16.326j ohms. When there is a frequency of 2.450925 GHz, its real input impedance is 52.202 ohms and its imaginary input impedance is −10.605j ohms. When there is a frequency of 2.49959375 GHz, its real input impedance is 52.074 ohms and its imaginary input impedance is −23.394j ohms.

FIG. 3 shows a voltage standing wave ration (VSWR) chart for the inventive PCB antenna measured by a network analyzer. The VSWR can respond reflection level of an antenna. A typical antenna has a VSWR of about 3, but for the inventive antenna, the VSWR is 1.394, 1.234, 1.567 corresponding to frequencies 2.3985125 GHz, 2.450925 GHz, 2.49959375 GHz, respectively.

FIG. 4 shows the result of radiation pattern for the PCB antenna measured in a non-reflective room.

Figure 5:
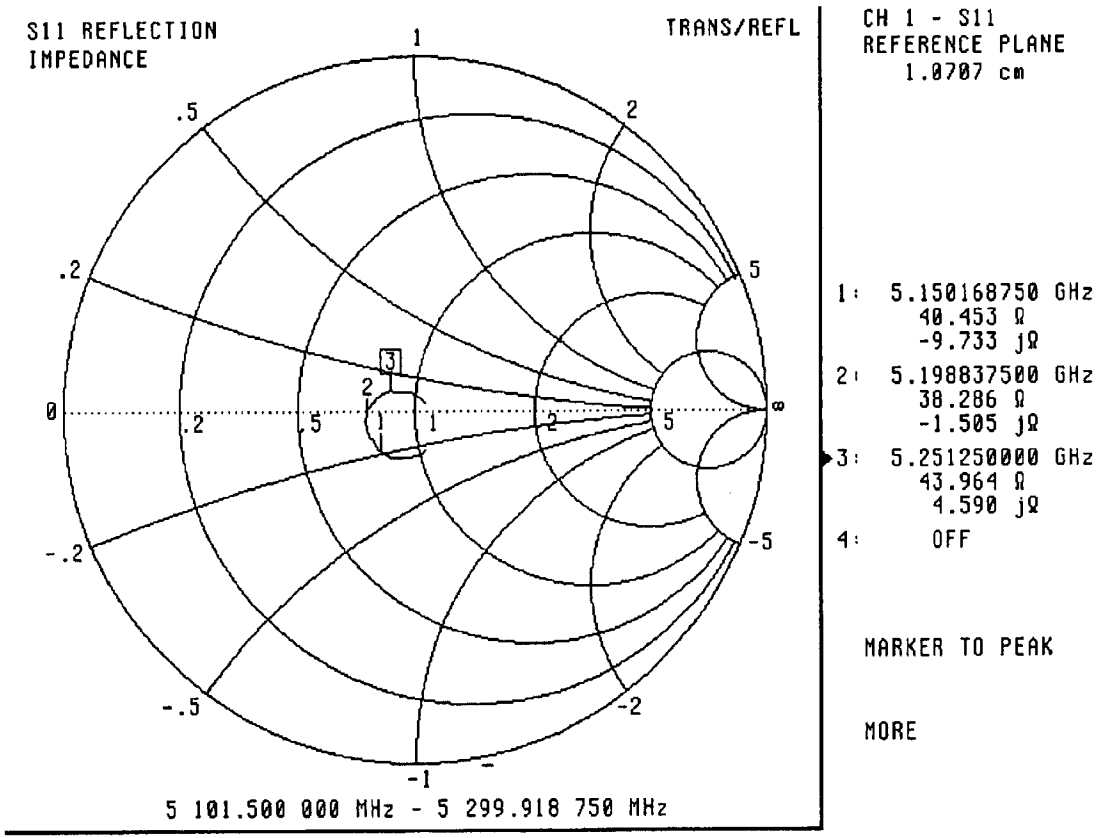
FIG. 5 is a view of a Smith impedance chart measured by the network analyzer at an operating band between 5.15 GHz and 5.25 GHz.
Figure 6:
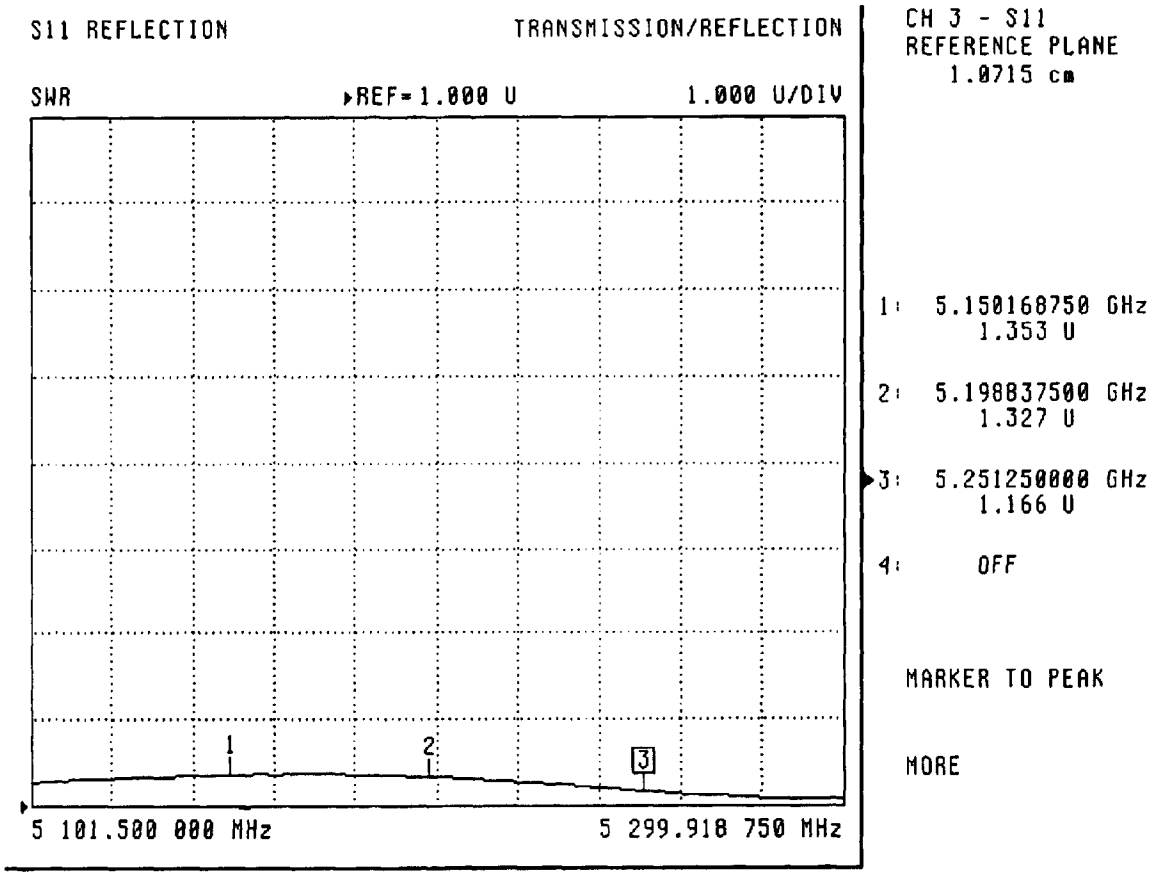
FIG. 6 is a view of a voltage standing wave ratio (VSWR) chart measured by the network analyzer at the operating band between 5.15 GHz and 5.25 GHz.
Figure 7:
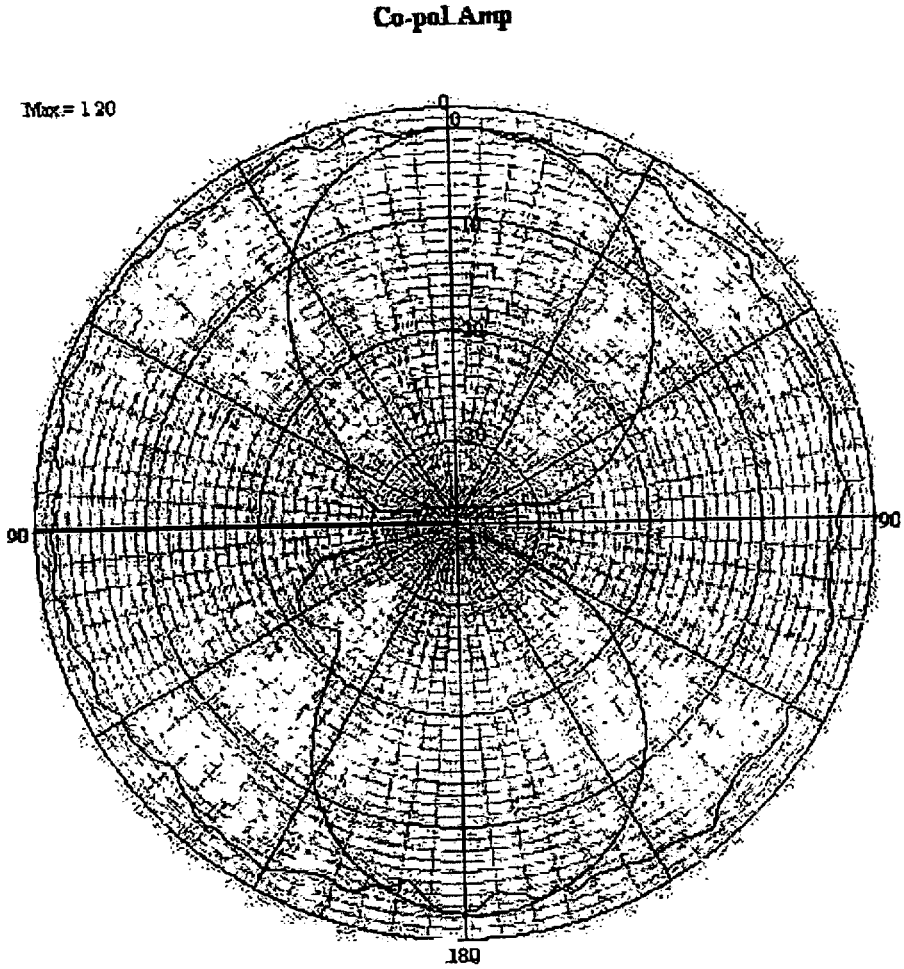
FIG. 7 is a view of antenna radiation pattern at the operating band between 5.15 GHz and 5.25 GHz.

FIGS. 5–7 show corresponding data for an inventive PCB antenna measured at a second operating band (5.15 GHz to 5.25 GHz). FIG. 5 shows a Smith impedance chart for the inventive PCB antenna measured by the network analyzer. As shown in FIG. 5, three important data are shown. When there is a frequency of 5.150168750 GHz, its real input impedance is 40.435 ohms and its imaginary input impedance is −9.733j ohms. When there is a frequency of 5.1988375 GHz, its real input impedance is 38.286 ohms and its imaginary input impedance is −1.505j ohms. When there is a frequency of 5.25125 GHz, its real input impedance is 43.964 ohms and its imaginary input impedance is 4.590j ohms.

FIG. 6 shows a voltage standing wave ration (VSWR) chart for the inventive PCB antenna measured by a network analyzer. The VSWR can respond reflection level of an antenna. For the inventive antenna, the VSWR is 1.353, 1.327, 1.166 under frequencies 5.150168750 GHz, 5.1988375 GHz, 5.25125 GHz, respectively.

FIG. 7 shows the result of radiation pattern for the PCB antenna measured in a non-reflective room.

Figure 8:
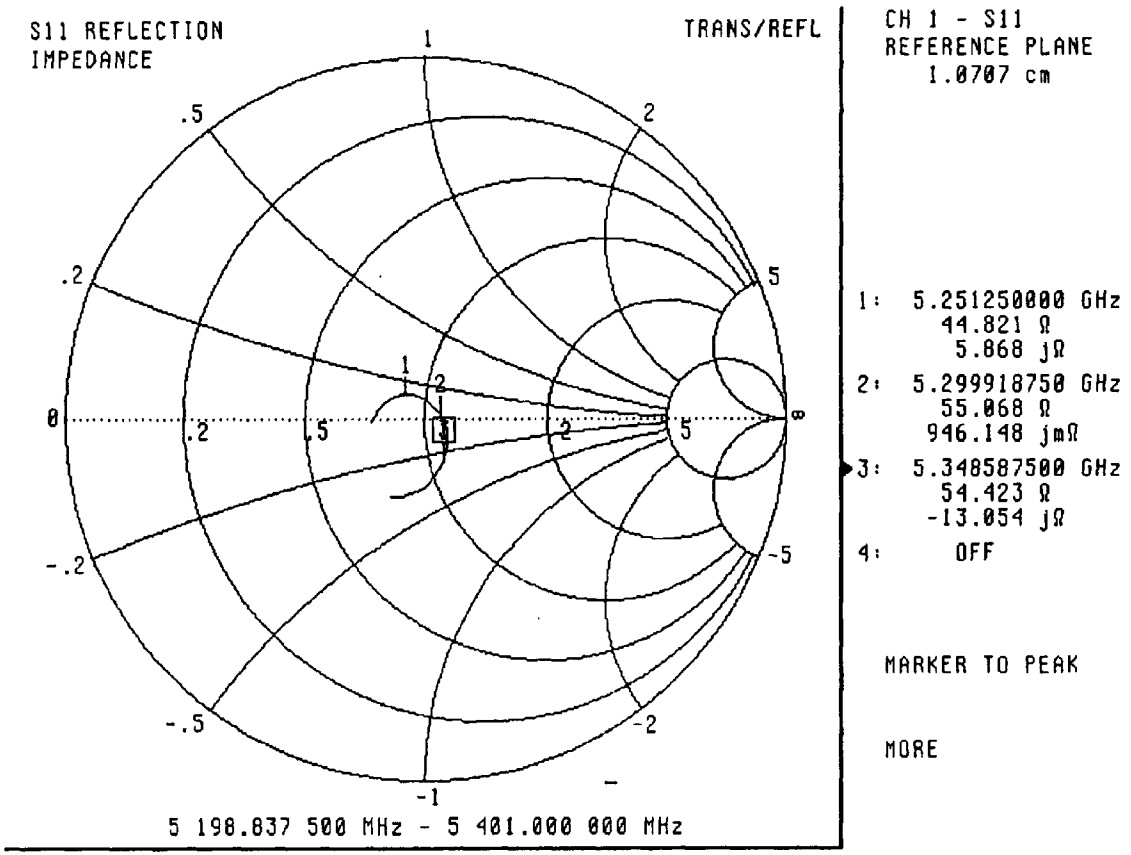
FIG. 8 is a view of a Smith impedance chart measured by the network analyzer at an operating band between 5.25 GHz and 5.35 GHz.
Figure 9:
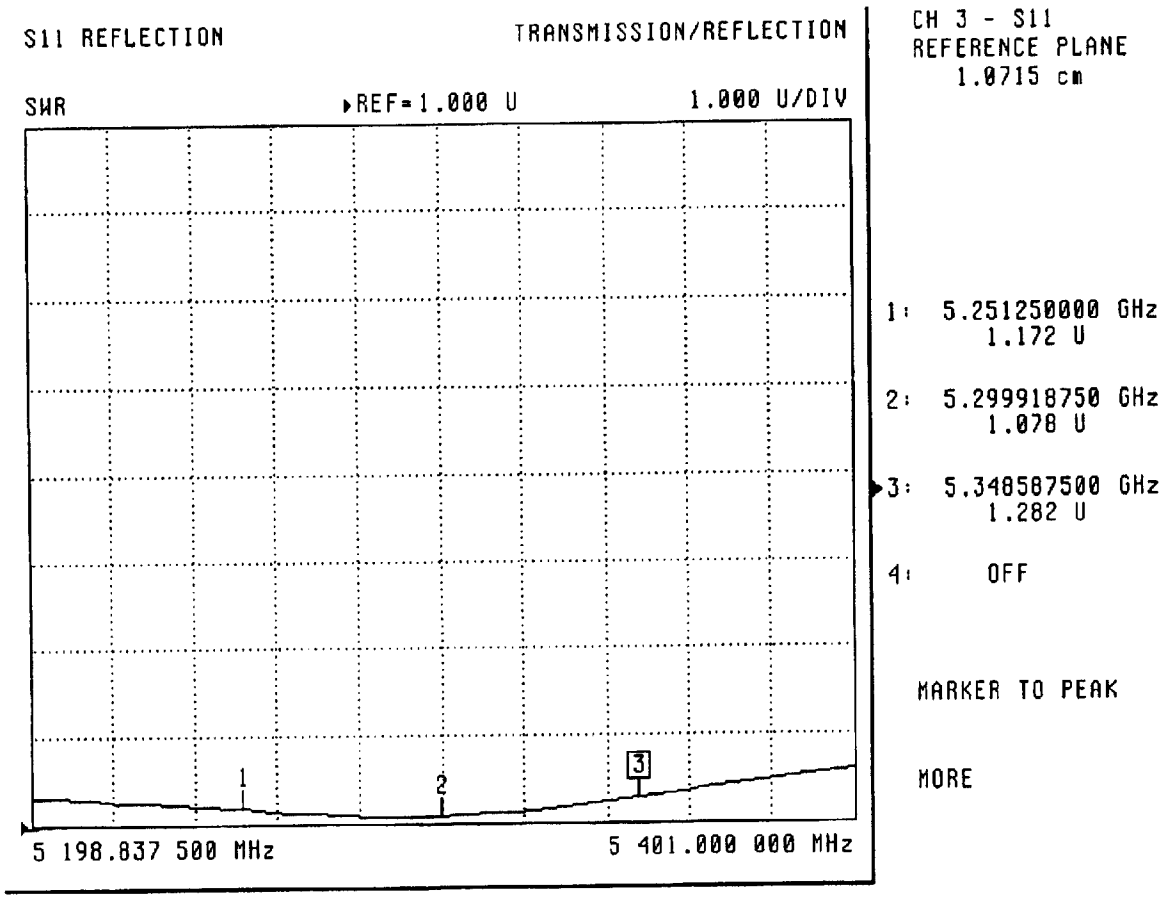
FIG. 9 is a view of a voltage standing wave ratio (VSWR) chart measured by the network analyzer at the operating band between 5.25 GHz and 5.35 GHz.
Figure 10:
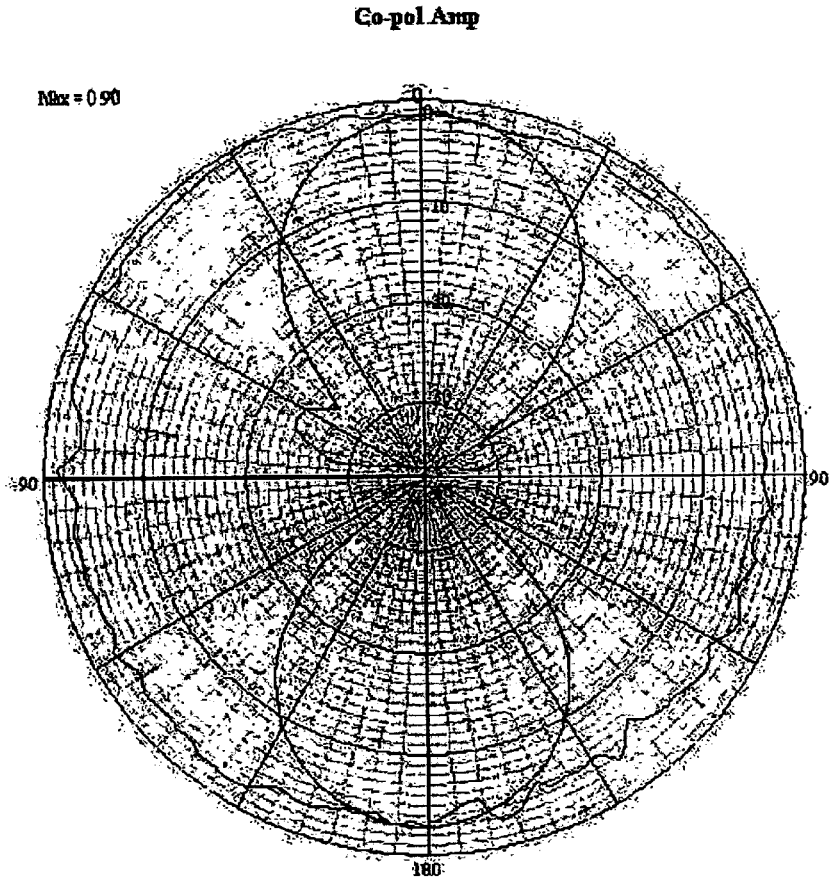
FIG. 10 is a view of antenna radiation pattern at the operating band between 5.25 GHz and 5.35 GHz.

FIGS. 8–10 show corresponding data for an inventive PCB antenna measured at a third operating band (5.25 GHz to 5.35 GHz). FIG. 8 shows a Smith impedance chart for the inventive PCB antenna measured by the network analyzer. As shown in FIG. 8, three important data are shown. When there is a frequency of 5.251250000 GHz, its real input impedance is 44.821 ohms and its imaginary input impedance is 5.868j ohms. When there is a frequency of 5.299918750 GHz, its real input impedance is 55.068 ohms and its imaginary input impedance is 0.946148j ohms. When there is a frequency of 5.348587500 GHz, its real input impedance is 54.423 ohms and its imaginary input impedance is −13.054j ohms.

FIG. 9 shows a voltage standing wave ration (VSWR) chart for the inventive PCB antenna measured by a network analyzer. The VSWR can respond reflection level of an antenna. For the inventive antenna, the VSWR is 1.172, 1.078, 1.282 under frequencies 5.251250000 GHz, 5.299918750 GHz, 5.348587500 GHz, respectively.

FIG. 10 shows the result of radiation pattern for the PCB antenna measured in a non-reflective room.

Figure 11:
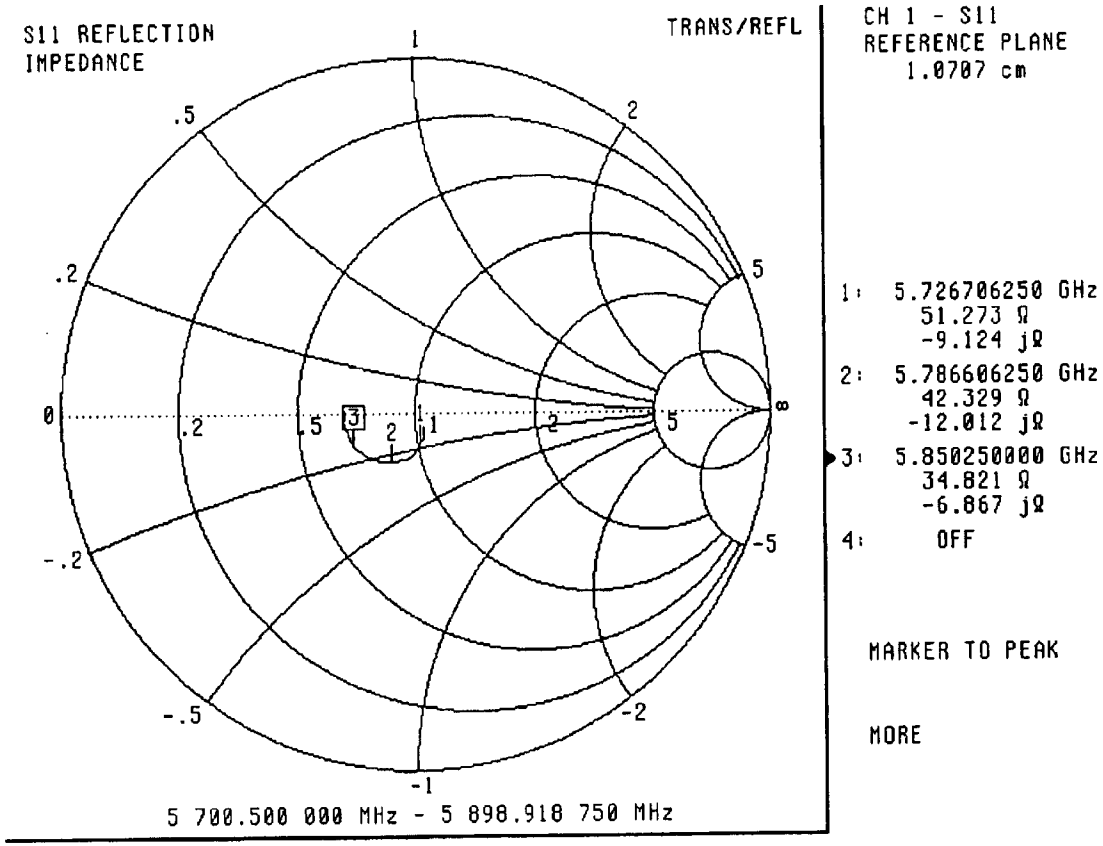
FIG. 11 is a view of a Smith impedance chart measured by the network analyzer at an operating band between 5.725 GHz and 5.85 GHz.
Figure 12:
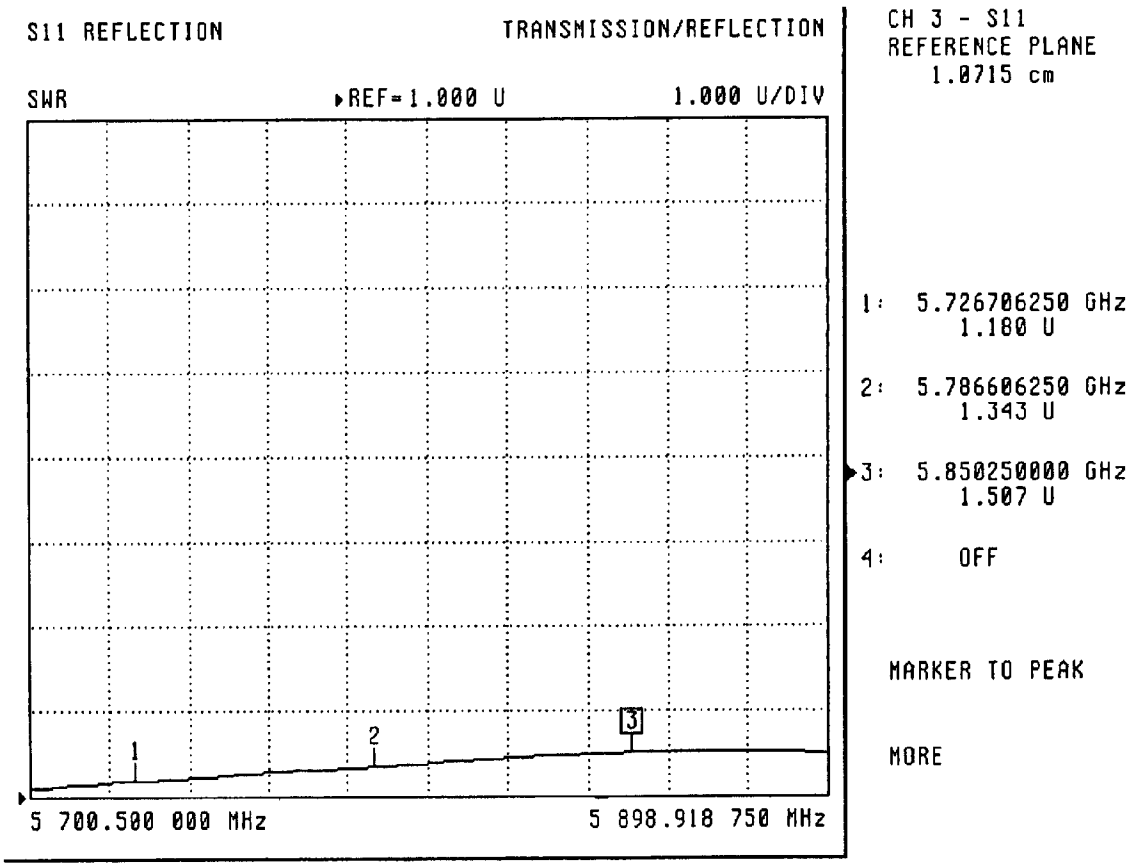
FIG. 12 is a view of a voltage standing wave ratio (VSWR) chart measured by the network analyzer at the operating band between 5.725 GHz and 5.85 GHz.
Figure 13:
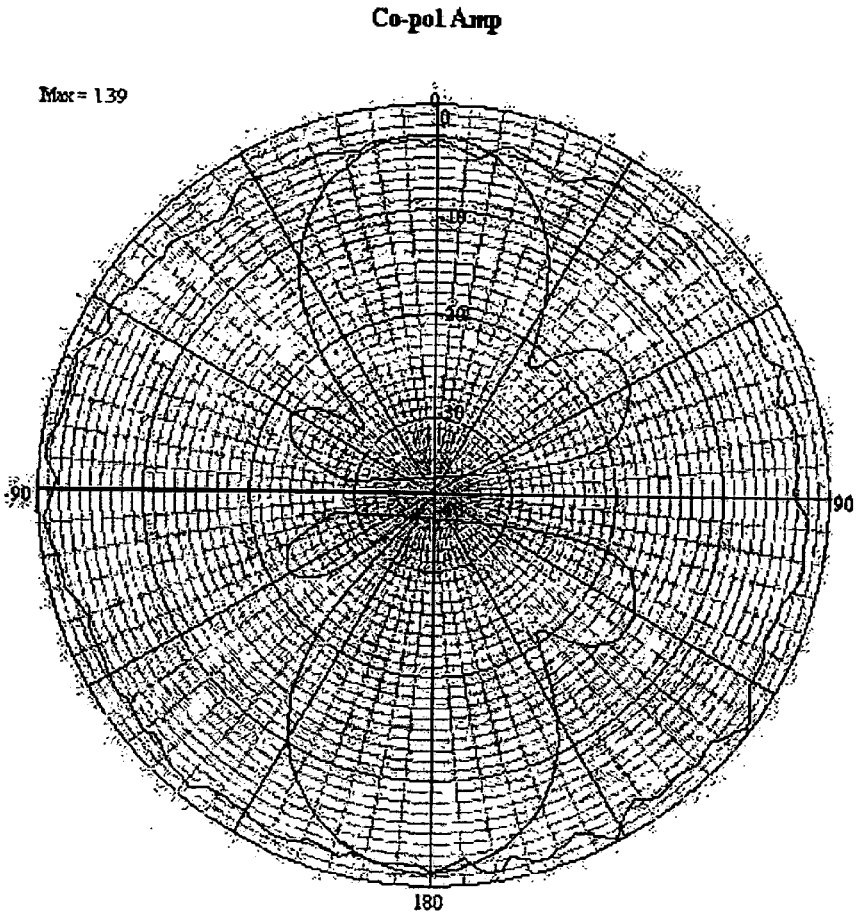
FIG. 13 is a view of antenna radiation pattern at the operating band between 5.725 GHz and 5.85 GHz.

FIGS. 11–13 show corresponding data for an inventive PCB antenna measured at a fourth operating band (5.725 GHz to 5.85 GHz). FIG. 11 shows a Smith impedance chart for the inventive PCB antenna measured by the network analyzer. As shown in FIG. 11, three important data are shown. When there is a frequency of 5.726706250 GHz, its real input impedance is 51.273 ohms and its imaginary input impedance is −9.124j ohms. When there is a frequency of 5.786606250 GHz, its real input impedance is 42.329 ohms and its imaginary input impedance is −12.012j ohms. When there is a frequency of 5.850250000 GHz, its real input impedance is 34.821 ohms and its imaginary input impedance is −6.867j ohms.

FIG. 12 shows a voltage standing wave ration (VSWR) chart for the inventive PCB antenna measured by a network analyzer. The VSWR can respond reflection level of an antenna. A typical antenna has a VSWR about 3, but for the inventive antenna, the VSWR is 1.172, 1.078, 1.282 under frequencies 5.726706250 GHz, 5.786606250 GHz, 5.850250000 GHz, respectively.

FIG. 13 shows the result of radiation pattern for the PCB antenna measured in a non-reflective room.

From the results shown, the invention has proven the ability of dynamically receiving signals among the cited four operating bands and thus the problem of only receiving and transmitting single- or double-band signals in the prior art is overcome.

Accordingly, the inventive PCB antenna can be shared by four operating bands to receive and transmit via switching, so the manufacturing cost is reduced and the disadvantage of only receiving and transmitting single- or double-band signals in the typical linear antenna is overcome. The invention provides a small-size and light-in-mass PCB antenna, which is compatible with a product's aesthetics and easily concealed as combined with the product. The invention also provides a PCB antenna having features of easy integration, low mass-production cost and high yield.

Although the present invention has been explained in relation to its preferred embodiment, it is to be understood that many other possible modifications and variations can be made without departing from the spirit and scope of the invention as hereinafter claimed.

What is claimed is:

1. A printed circuit board (PCB) antenna capable of receiving four operating bands, comprising:

a substrate;

an A-side metal electrode plate, printed on one side of the substrate, the A-side metal electrode plate grounded to a reflection plane to form a U opening, the U opening having symmetric metal sheet on left and right sides respectively, each symmetric sheet having a plurality of fragments to form an intermittent metal plane, a plurality of metal ring electrodes and a plurality of metal connecting sheets implemented in a middle portion of the U opening; and a B-side metal electrode plate, located on the other side of the substrate and circuit-shorted to one of the metal ring electrodes of the A-side metal electrode plate.

2. The PCB antenna as claimed in claim 1, wherein the plurality of metal ring electrodes are two ring electrodes with different sizes.

3. The PCB antenna as claimed in claim 2, wherein the plurality of metal ring electrodes are four ring electrodes.

4. The PCB antenna as claimed in claim 2, wherein the plurality of metal connecting sheets are four metal connecting sheets, and respectively connected between the metal ring electrodes, one of the metal ring electrodes extended toward a bottom of the U opening.

5. The PCB antenna as claimed in claim 2, wherein the plurality of metal ring electrodes respectively have an internal diameter and an external diameter, a ratio of the internal diameter to the external diameter about 0.25.

6. The PCB antenna as claimed in claim 1, wherein the plurality of fragments are six fragments.

7. The PCB antenna as claimed in claim 6, wherein each fragment is 0.2–0.5 mm.

8. The PCB antenna as claimed in claim 1, wherein one of the metal ring electrodes is circuit-shorted to the B-side metal electrode plate.

9. The PCB antenna as claimed in claim 8, wherein the one metal ring electrode is located at a top of the U opening.

10. The PCB antenna as claimed in claim 8, wherein the one metal ring electrode is drilled.

11. The PCB antenna as claimed in claim 1, wherein an extension at a top of the U opening of the A-side t metal electrode plate has a width of 3-2.2 multiple proportion to an extension at a top of the B-side metal electrode plate.

* * * * *